US008082629B2

(12) United States Patent
Migli

(10) Patent No.: US 8,082,629 B2
(45) Date of Patent: Dec. 27, 2011

(54) HINGE WITH REDUCED BULKINESS FOR VERTICAL-MOVEMENT DOORS

(75) Inventor: Carlo Migli, Lecco LC (IT)

(73) Assignee: Agostino Ferrari S.p.A., Bergamo BG (IT)

( * ) Notice: Subject to any disclaimer, the term of this patent is extended or adjusted under 35 U.S.C. 154(b) by 410 days.

(21) Appl. No.: 11/984,873

(22) Filed: Nov. 23, 2007

(65) Prior Publication Data

US 2008/0115322 A1 May 22, 2008

(30) Foreign Application Priority Data

Nov. 22, 2006 (IT) ..... MI2006A2232

(51) Int. Cl.
*E05D 3/06* (2006.01)

(52) U.S. Cl. ..... 16/366; 16/286; 16/368; 16/289

(58) Field of Classification Search ..... 16/283, 16/286, 280, 281, 282, 287, 288, 289, 290, 16/293, 294, 302, 306, 366, 368, 369, 370, 16/291; 108/68, 108, 163, 166, 179; 49/246, 49/247, 248, 249; 312/330.1, 325, 327, 328, 312/329

See application file for complete search history.

(56) References Cited

U.S. PATENT DOCUMENTS

| | | | | |
|---|---|---|---|---|
| 4,012,807 | A * | 3/1977 | Kern | 16/288 |
| 6,182,952 | B1 * | 2/2001 | Gutierrez | 267/64.11 |
| 6,367,123 | B1 * | 4/2002 | Cheal et al. | 16/370 |
| 6,499,189 | B2 * | 12/2002 | Kondo et al. | 16/289 |
| 6,789,293 | B2 * | 9/2004 | Habegger et al. | 16/343 |
| 6,892,423 | B2 * | 5/2005 | Cheal et al. | 16/289 |
| 7,197,790 | B1 * | 4/2007 | Edmondson | 16/336 |
| 2001/0039762 | A1 * | 11/2001 | Giovannetti | 49/246 |
| 2005/0011045 | A1 * | 1/2005 | Lu et al. | 16/287 |
| 2005/0188505 | A1 * | 9/2005 | Bennett | 16/366 |
| 2008/0216289 | A1 * | 9/2008 | Salice | 16/366 |

FOREIGN PATENT DOCUMENTS

| | | | |
|---|---|---|---|
| DE | 9400568 | * | 3/1994 |
| DE | 195 19 341 | | 6/1996 |
| DE | 297 22 603 | | 4/1998 |
| DE | 197 45 203 | | 12/1998 |
| EP | 0730075 | * | 9/1996 |

OTHER PUBLICATIONS

European Search Report dated Dec. 4, 2008.

* cited by examiner

*Primary Examiner* — Victor Batson
*Assistant Examiner* — Jeffrey O'Brien
(74) *Attorney, Agent, or Firm* — Jacobson Holman PLLC

(57) ABSTRACT

A parallelogram hinge for vertical-movement doors includes a first plate designed to be fastened to the furniture flank, a second plate designed to be fastened to the door and two superposed arms pivotally mounted to the plates to form an articulated parallelogram. A spring for movement balancing is connected to the upper arm at an intermediate position between the arm extremities hinged to the plates and is connected to the first plate at a point below the pivot point of the lower arm on the first plate. This enables very reduced bulkiness in the direction of the furniture depth, achievement of a great opening angle and better operation of the spring embodied by a gas piston.

3 Claims, 2 Drawing Sheets

HINGE WITH REDUCED BULKINESS FOR VERTICAL-MOVEMENT DOORS

BACKGROUND OF THE INVENTION

1. Field of the Invention

The present invention relates to a parallelogram hinge for vertical-movement doors having a reduced bulkiness in depth at the inside of the piece of furniture.

2. State of the Prior Art

Commonly used are articulated-parallelogram hinges adapted to move doors in a vertical direction with combined translation and rotation movements so as to fully clear the access opening to the inside of the piece of furniture. Due to their features, these opening systems are currently used for tall pieces of furniture, such as kitchen wall cupboards, for example.

To balance the door weight during movement, gas springs are currently used, these springs being preferred to the helical springs because they enable quite higher loads, the sizes being the same.

The configuration normally used is that shown in FIG. 1 where a known parallelogram hinge is represented, being generally denoted at 10, in an open position (in chain line the closed position is partly shown). The gas spring 11, pivotally mounted on the fixed plate 13 at 12, exerts pressure on pin 14 that is integral with lever 15. In this manner, the dead centre positioned near the door closure being overcome, the whole mechanism consisting of levers 15 and 16 pivotally mounted on the movable plate 17 integral with door 18, is pushed in the opening direction. If the spring force is calculated in a correct manner, a balancing effect of the door weight is obtained which enables opening of said door to be controlled with a minimum effort.

All known mechanisms use gas springs mounted as shown in FIG. 1, i.e. with thrust axis substantially perpendicular to the plane of the closed door.

The main advantage offered by this choice consists in the possibility of only partly superposing the gas spring over the levers constituting the kinematic mechanism. Levers 15 and 16 lie in the same plane and the pivot point 14 is raised so as to avoid contact between the levers and the spring 11 during movement. If the spring is disposed as shown in FIG. 1, its body of greater diameter will never interfere with the work plane of the levers and the pivot point 14 can be raised relative to the lever planes only a minimum indispensable amount so as to avoid any interference with the spring rod. In this way, the whole mechanism has a reduced side bulkiness.

However, this configuration has some problems. In fact, while the side bulkiness of the mechanism is reduced, the bulkiness in depth is high because, as viewed from FIG. 1, it is necessary to take into account the spring length to which the space required for the kinematic mechanism is to be added. In addition, spring 11 works in an almost horizontal position, and therefore in a non-optimal manner with respect to the manufacturers' suggestions for this type of springs who teach to always keep the springs with the rod facing downwards to enable better lubrication of the seals. A further problem is represented by the pivot point 14 that must necessarily be located at a position that can limit maximum opening of the kinematic mechanism.

It is a general aim of the present invention to obviate the above mentioned drawbacks by providing an innovative parallelogram hinge for vertical-movement doors which has a reduced bulkiness in depth at the inside of the piece of furniture. Further aims consist in enabling better operation of the balancing spring and avoiding inappropriate limitations to the maximum opening.

SUMMARY OF THE INVENTION

In view of the above aims, in accordance with the invention a parallelogram hinge for vertical-movement doors has been conceived which comprises a first plate designed to be fastened to the furniture flank and a second plate designed to be fastened to the door, between the first and second plates two superposed arms being pivotally mounted so as to form an articulated parallelogram with the plates, a movement balancing spring being linked between the first plate and one of the arms, characterized in that the spring is connected to the upper arm at an intermediate position between the hinged extremities of the arm to the plates and is connected to the first plate at a point below the pivot point of the lower arm on the first plate.

BRIEF DESCRIPTION OF THE DRAWINGS

For better explaining the innovative principles of the present invention and the advantages it offers over the known art, a possible embodiment applying these principles will be described hereinafter by way of non-limiting example, with the aid of the accompanying drawings. In the drawings.

DETAILED DESCRIPTION OF THE INVENTION

Figure 1:
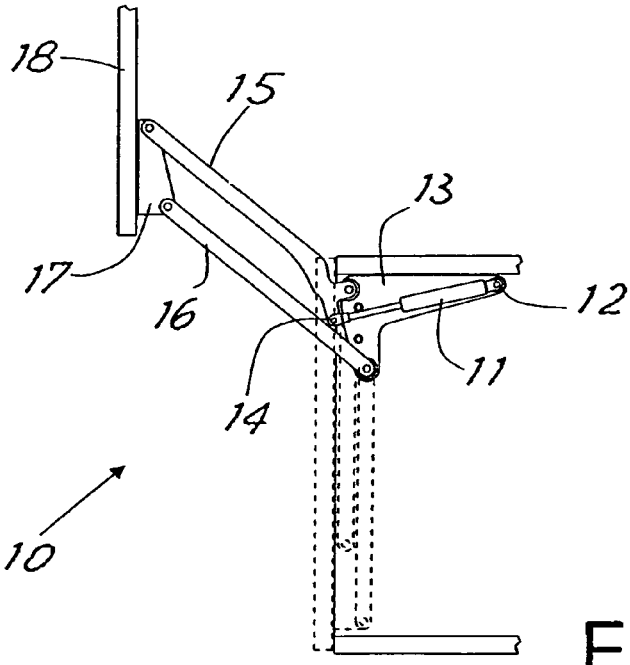
Fig. 1 PRIOR ART
FIG. 1 is a diagrammatic side view of a hinge of the known art.

With reference to the drawings, shown in FIG. 1 is a parallelogram hinge made according to the known art, already described above, while shown in FIG. 2 is a parallelogram hinge generally identified with 110, made according to the principles of the present invention.

Hinge 110 comprises a first plate 113 designed to be fastened to the flank of the piece of furniture and a second plate 117 designed to be fastened to the door 118 of the piece of furniture to provide it with a vertical opening-closing movement.

Pivotally mounted between the first and second plates are two superposed arms 115, 116 to form an articulated parallelogram with the plates, the rotation points of which are at 120, 119 and 121, 122.

A balancing spring 111, advantageously of the piston gas type, is connected between the first plate 113 and upper arm 115. An extremity 114 of the spring is pivotally connected to the upper arm 115 at a position (close to the pivot point 119 of the arm) that is intermediate between the hinged extremities 119, 120 of the arm on the plates, while the other extremity 112 of the spring is pivotally connected to the first plate 113 at a point 112 that is below the pivot point 121 of the lower arm 116 on the first plate 113.

Figure 2:
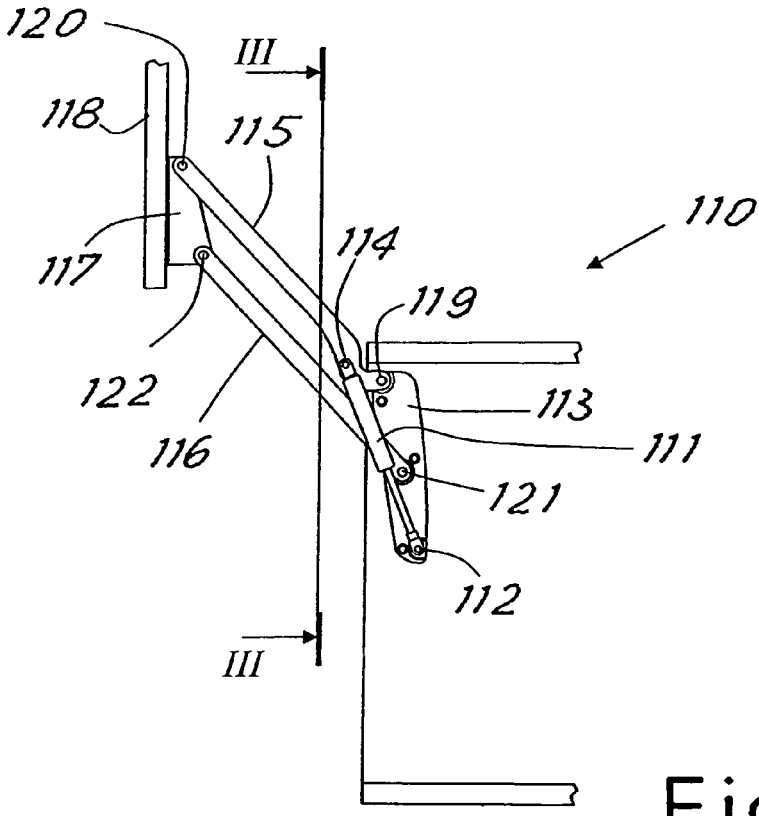
FIG. 2 is a diagrammatic side view of a hinge made according to the invention, in an open position.

Advantageously, as clearly seen in FIG. 2, the pivot points 119, 121 and 112 of arms 115, 116 and spring 111 on the first plate 113 are substantially in alignment with each other in the plate plane. Still advantageously, the pivot point 114 of spring 111 on the upper arm 115 is offset towards the lower arm 116 relative to the line joining the pivot points 119, 120 of the upper arm 115 on the two plates 113 and 117.

The spring is located in such a plane that any interference with the components of the kinematic mechanism is avoided as regards both the rod and the body of greater diameter.

Figure 3:
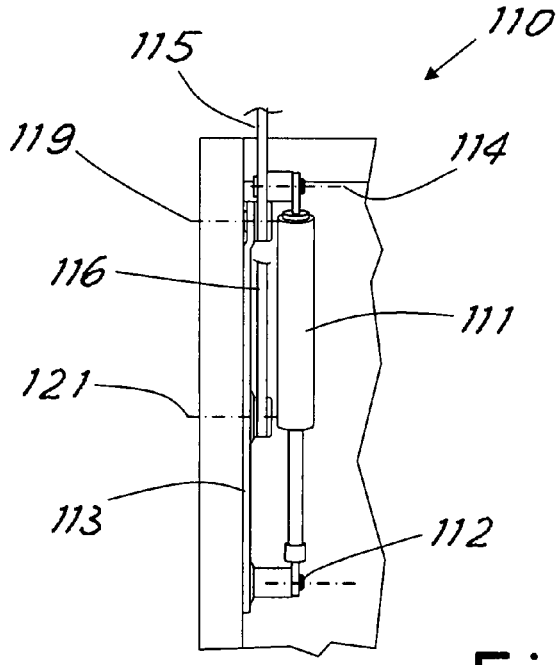
FIG. 3 represents a partial front view of the hinge taken along line III-III in FIG. 2.

Shown in FIG. 3 is a front view of the kinematic mechanism of the hinge where it is possible to see that the spring is offset more inwards of the piece of furniture than the arms of the articulated parallelogram due to suitable spacers on the pivot points 112 and 114.

Figure 4:
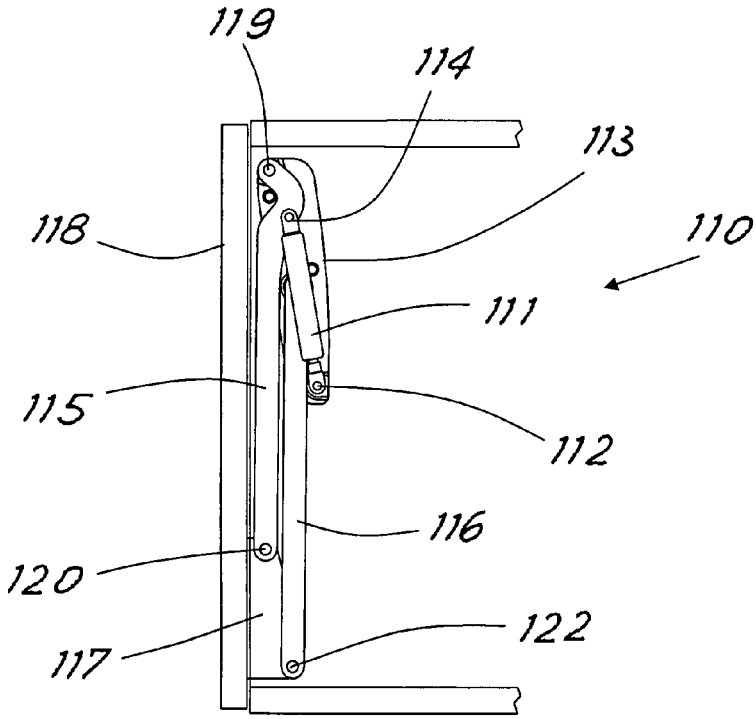
FIG. 4 is a side view of the hinge seen in FIG. 2 in a closed position.

Shown in FIG. 4 is the hinge in a fully closed position.

It is apparent from the figures that due to the particular arrangement described, spring 111 can completely overlap the kinematic mechanism. It can be therefore advantageously positioned with its axis almost vertical and the rod facing downwards. Use of the piston spring mounted with its rod facing downwards enables, among other things, better lubrication of the spring seals to be achieved.

Against a slightly greater side bulkiness due to overlapping of the spring and lower arm 116, there is a well apparent reduction in the required space in the direction of the piece of furniture depth as compared with the solution of the known art.

As shown in FIG. 4, in this direction bulkiness is substantially reduced to the width of the parallelogram arms to which hinging of the spring on the plate fastened to the furniture flank is to be added.

This reduction in bulkiness for example enables use of the vertical-movement hinge also in furniture with a minimum depth, such as small bath wall cabinets. A further advantage connected with this type of configuration is represented by the smaller sizes required for packaging. In fact, hinges are usually shipped in a closed position (often with the gas spring disassembled). It is apparent that the hinge in accordance with the invention allows much room to be saved since its extension in the closed position is mainly in a single direction.

In addition, the hinge according to the innovative positioning of the spring allows the pivot points to be in such a position that no limits to movement of the kinematic mechanism are created so that for instance a great opening angle, larger that that of the kinematic mechanisms of the known art, can be obtained.

In spite of the important advantages of the new hinge as compared with the known art shown in FIG. 1, the levers and movable plate 117 can be easily sized with distances between centers and pivot points capable of carrying out the same kinematic movement as the hinge in FIG. 1.

Obviously, the above description of an embodiment applying the innovative principles of the present invention is given by way of example only and therefore must not be considered as a limitation of the scope of the patent rights herein claimed. For instance, the proportions and conformation of the different parts can be varied depending on specific practical requirements.

What is claimed is:

1. A parallelogram hinge for vertical movement doors, said parallelogram hinge comprising a first plate for fastening to a furniture flank, a second plate designed for fastening to a door, an upper arm and a lower arm pivotally mounted between the first plate and the second plate to form an articulated parallelogram along with the first plate and the second plate, the upper arm extending substantially parallel to the lower arm, a movement-balancing spring linked between the first plate and the upper arm, the movement-balancing spring being connected to the upper arm at a pivot point located at an intermediate position between hinged extremities of the upper arm to the first plate and the second plate and being connected to the first plate at a point below a pivot point of the lower arm on the first plate, the upper arm, the lower arm and the movement-balancing spring being connected to the first plate at respective pivot points, the respective pivot points being aligned with each other along a linear line in a plane on the first plate, the pivot point of the movement-balancing spring on the upper arm being on one side of the linear line in an open position of the movement-balancing spring and the pivot point of the movement-balancing spring on the upper arm being on an opposite side of the linear line in a closed position of the movement-balancing spring, in the closed position of the movement-balancing spring, a depth of the movement-balancing spring being reduced to a width of the upper arm and the lower arm.

2. The hinge as claimed in claim 1, wherein the pivot point of the movement-balancing spring on the upper arm is offset towards the lower arm relative to a line joining the pivot points of the upper arm to the first plate and the second plate.

3. The hinge as claimed in claim 1, wherein the movement-balancing spring is a piston spring mounted with a rod facing downwards.

* * * * *